United States Patent [19]

Walker, Jr.

[11] 4,386,543

[45] Jun. 7, 1983

[54] DEVICE FOR LOCKING STANDING SEAM ROOF PANELS

[76] Inventor: Walter N. Walker, Jr., 1226 W. Edgewater Dr., Tucson, Ariz. 85704

[21] Appl. No.: 241,445

[22] Filed: Mar. 6, 1981

[51] Int. Cl.[3] ..... B25B 7/02

[52] U.S. Cl. ..... 81/420; 269/265; 29/268

[58] Field of Search ..... 81/420, 418; 29/268, 29/267; 269/265, 257

[56] References Cited

U.S. PATENT DOCUMENTS

| | | | |
|---|---|---|---|
| 2,679,775 | 6/1954 | Fleming | 81/420 |
| 2,731,932 | 1/1956 | Petersen | 81/372 |
| 2,990,863 | 7/1961 | Pantermoller | 81/418 |
| 3,304,818 | 2/1967 | Heaton | 81/420 |

FOREIGN PATENT DOCUMENTS

| | | | |
|---|---|---|---|
| 60271 | 7/1913 | Austria | 81/420 |
| 1238043 | 6/1960 | France | 81/368 |

*Primary Examiner*—James L. Jones, Jr.
*Attorney, Agent, or Firm*—J. Michael McClanahan

[57] ABSTRACT

A device for locking sheet metal standing seam roof panels of the type where a male leg portion of the seam is lifted up into a female leg portion of the seam in order that a partially punched and extending outward locking button on the male leg engages a turned-up hook on the female leg portion, the device comprising a pair of elongated means attached to the jaws of a duck bill toggle type pliers for urging the male leg portion into the female leg portion for locking, one of the pair of elongated means comprising a right angle iron piece adapted to encompass the apex of the rolled over female leg portion which forms the cavity, and the other of the pair of means a square rod adapted to engage a downward extending lip on the male leg portion forming the protrusion, each of said elements attached to different jaws of the duck bills of the vise grips, such that the toggle type pliers being placed into position and closed results in the square rod engaging downward extending lip and pushing upward into position for locking the male leg portion until the partially punched through and extending outward locking button on the male leg rides up over the end of the turned-up hook on the female portion of the leg, which, when removing the toggle type pliers results in the hook engaging and holding the locking button.

2 Claims, 3 Drawing Figures

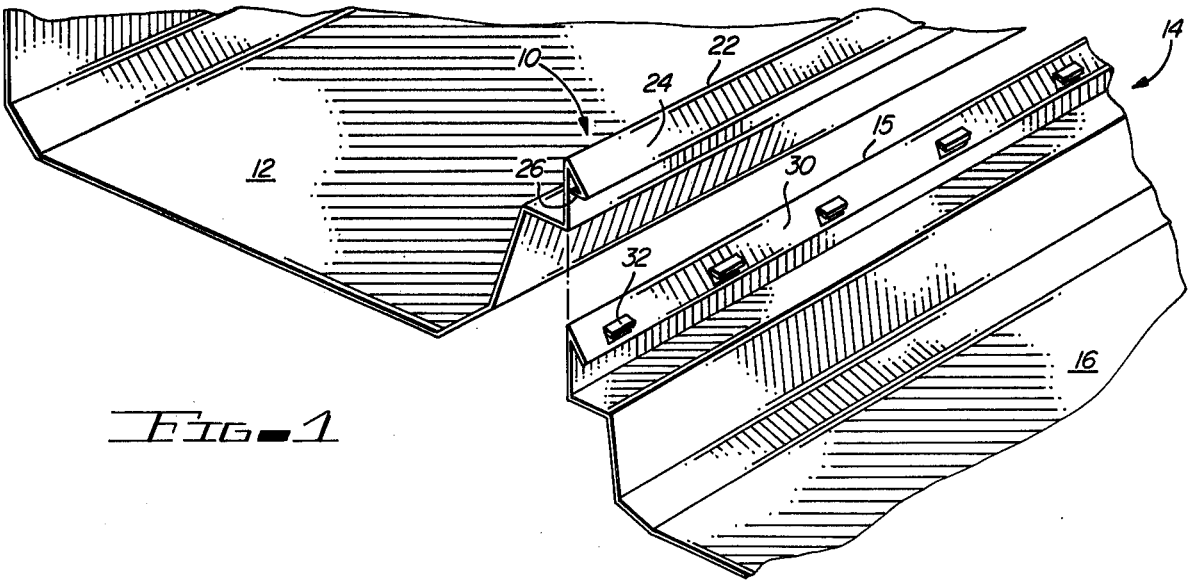
FIG. 1
FIG. 2
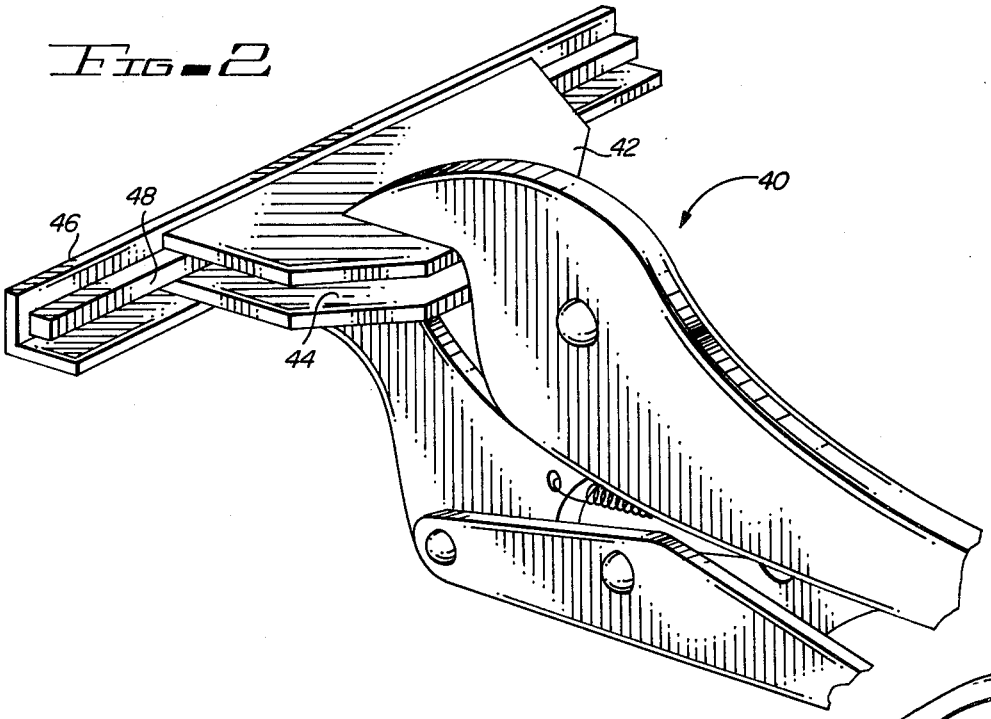
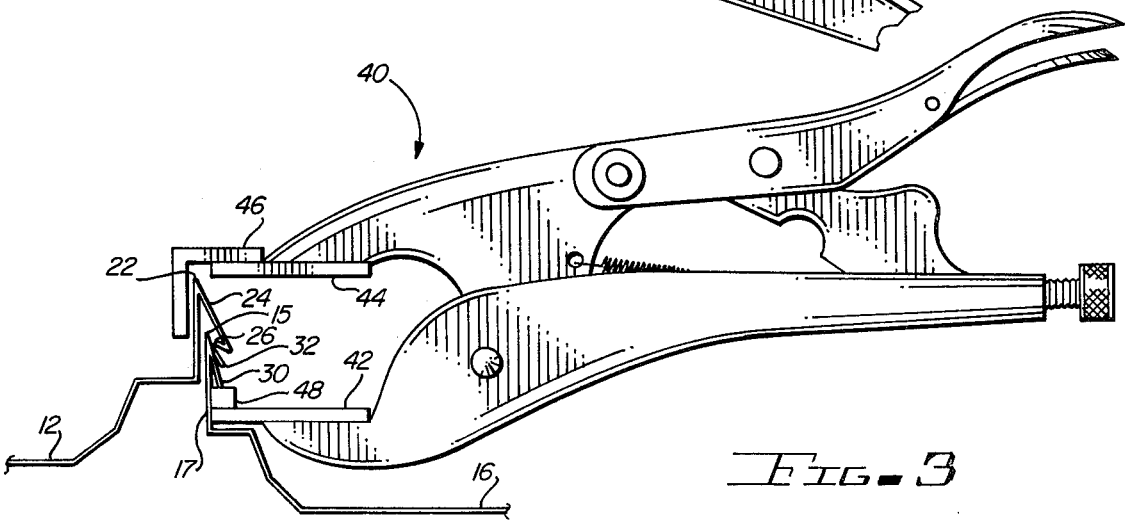
FIG. 3

DEVICE FOR LOCKING STANDING SEAM ROOF PANELS

BACKGROUND OF THE INVENTION

In the building construction industry new products have been developed to provide means of making rain waterproof the joinder of adjacent elongated sheet metal panels that are laid on the roofs of industrial and other type buildings. In this new generation of roof panels is one type known as standing seam type panel roofing wherein elongated sheets of steel plate, usually galvanized with a zinc coating, have been developed where the sides of these elongated sheets are formed into alternate male and female leg portions in order that adjacent panels should engage each other in a type of seam that is substantially rain waterproof. To this technology comes the standing seam to which the inventive tool hereinafter described, is applied.

In order to attach and lock the parallel adjacent panels together, one side edge of the panel is formed into a female locking leg which comprises, in its simpliest form, an upward rising elongated cavity made by folding over the metal in the longitudinal direction to form an apex at the top of the seam with the downward going folded over portion of the metal then being folded in again to form a turned up hook assembly.

Then, the side edge of the adjacent panel is formed into a male leg portion wherein the metal along the edge is bent to an upward rising position with the strip of metal immediately adjacent to the edge folded downward to make a running lip. Into this lip is partially punched a plurality of rectangular shaped locking button or tab, the locking button punched on three sides, namely the bottom and the two ends, whereupon the locking button is swung outward at an acute angle from the lip hinging at the top portion remaining non-severed.

The standing seam roof panels then are joined in locking relationship by the male leg portion engaging the female leg portion such that the outward pointing locking buttons engage the inwardly and upwardly pointing hook of the female portion of the panel seam.

In the past, the locking of the male and female leg portions has been accomplished by utilization of slip-joint pliers which have resulted, because of their limited lateral engagement of the seam and the difficulty of alignment of the plier's jaws to the male leg portion lip (which according to one manufacturer's instructions should be accomplished utilizing a mirror), of the metal being torn since excessive pressure may be applied very easily. Also, this method of locking only allows locking of one locking button at a time. Obviously, and most importantly in the production of work, exceptionally long periods of time are required for the operator to lock each of the plurality of the locking buttons with the female leg portion hook, a very undesirable feature.

Now in the past there have been special tools developed for particular applications, such as the pliers-type hand tool which was patended by C. C. Schmidt in U.S. Pat. No. 3,314,319 where Schmidt has adapted a type of toggle type pliers having duck bill jaws adapted to draw edges of adjacent duct work sections together in order that a holding cleat may be secured about the edges of the sections. Similarly, Wagner, in U.S. Pat. No. 2,803,320 illustrates a similar pair of toggle type pliers wherein the jaws have been adapted by special construction to draw a window frame to a wall covering over and holding a sealing strip until a nail has been driven through the frame and into the wall.

Further Bannies, in U.S. Pat. No. 3,572,191 illustrates a toggle type pliers adapted to close a seam formed of plurality of tongues and grooves where the vise grip jaws have been specially contoured to embrace and retain the overlapping edges of the seam for camming the edges into the tongue and groove interlocking engagement.

It becomes readily apparent that as new types of materials become developed for specific applications, there will be need for tools with which to most expediently work with these new materials and methods.

SUMMARY OF THE INVENTION

The invention disclosed herein comprises an improvement made to a pair of prior art duck bill toggle type pliers in order that the locking together of the seam in a standing seam roof panel construction may be accomplished very swiftly. To this end, the duck bill toggle type pliers jaws i.e., the duck bills, are modified by addition of two elements, namely an element attached to one of the duck bills to engage and hold in place the top of the outer covering female leg portion of the roof panel seam, while the other duck bill is adapted with an element which aligns to the male leg portion and engages the downward extending lip of the male leg portion of the roof panel in order that the male leg portion may be urged up into the cavity of the female leg portion to effectuate a locking connection.

More specifically, to the lower duck bill jaw of the toggle type pliers is welded a right angle-angle iron piece, the inside of the angle iron on the outside surface of the duck bill with the 90° flange of the other part of the angle iron piece pointing in the direction of the other duck bill jaw. The angle iron piece is so arranged with the duck bill that an elongated groove is formed between the exterior edge of the duck bill and the inside corner of the angle iron piece. Then, attached to the upper duck bill jaw, and lying upon the inside flat portion of the duck bill jaw adjacent its outer edge is welded a square rod.

Now, with these elements, the inventive tool may be applied to the standing seam roof panels where firstly, the toggle type pliers are rolled by 180° from the usual normal appearing configuration to where the jaw having the angle iron piece attached is now superior to the jaw having the square rod attached. The angle iron is placed in position over the apex of the female leg portion of the seam, and the square rod, now in the inferior or lower position, is aligned juxtaposed the vertically upright portion of the male leg portion of the standing seam roof panel. The square rod now engages the bottom edge of the downward extending lip of the male leg portion. As previously mentioned, formed into the edge of the roof panel having the female leg portion is the turned up hook, and formed in the downward extending lip of the male leg portion partially punched outward extending locking button.

The inventive tool, upon the closing of the handles of the toggle type pliers, lifts up the male leg portion to the interior of the apex of the female leg portion whereupon the locking button on the male leg portion lip rises over the hook of the female leg portion. The male leg portion is continued up into the female leg cavity until it bottoms against the upper wall at which time the vise grips are relaxes and the male leg portion allowed to drop. As it drops, the female leg hood engages the male leg locking button.

After the engagement and locking connection, the tool is then slid along the seam to the next position.

Accordingly, it is an object of the subject invention to provide means by which to facilitate locking of the male and female leg portions of standing seam roof panels.

BRIEF DESCRIPTION OF THE DRAWINGS

FIG. 1 is a perspective view of the standing seam roof panel in an unlocked disassembled configuration.

FIG. 2 is a perspective view of the subject inventive tool.

FIG. 3 is a side view of the inventive tool in position acting to lock the standing seam roof panels.

DETAILED DESCRIPTION OF THE PREFERRED EMBODIMENT

Referring now to FIG. 1, a perspective view of the standing seam roof panels to which the inventive device is applied is shown. These panels, usually made of elongated lengths of sheet galvanized steel, are originally flat and then on each longitudinal side, are formed a male and a female leg which are adapted to join with their mate to form the overlapping, continuous, elongated seam which provides, when combined with adjacent panels, the rain waterproof roof. When viewed from afar, the roof will appear to be substantially flat with thin elongated protrusive seams, which of course are the male and female legs engagement. Of course the panels are sitting on purlins (not shown) which also run across the roof and provide the under support for the panels.

As seen in FIG. 1, the overencompassing female leg 10 of roof panel 12 is shown in vertical alignment with male leg 14 of adjacent roof panel 16. When these panels are joined, female leg 10 will cover and become affixed to male leg 14 as explained hereinafter. The central flat portion of roof panel 12 will be on the same horizontal plane as roof panel 16 after the fastening is accomplished.

More specifically, female leg 10, in pertinent part, rises upward from the planar portion of roof panel 12 to its highest point where the metal is folded or rolled over to point downward which in turn forms an elongated rectangular lip 24 which, at the metal edge is again folded under in a continuing clockwise direction to form turned-up hook 26. As shown in FIG. 1, lip 24 runs the total length of the roof panel as does the hook 26.

Then, upon the next adjacent panel, the male leg portion is formed along the longitudinal edge also rising in a generally upward direction perpendicular to the planar portion of roof panel 16 where, in the portion of the panel immediately parallel to the edge, the metal is folded or rolled over to form rectangular lip 30. In lip 30 is formed a plurality of rectangularly shaped locking buttons 32, nominally at about four inch intervals, which locking buttons are constructed by partially punching on three sides the metal in lip 30, i.e., along the bottom and the two ends. The top edge portion of locking button 32 is not been separated or severed from lip 30. Then, locking button 32 is bent outward a slight distance from lip 30 so that locking button 32 is at an acute angle with respect to lip 30, i.e., generally protruding outward.

As obvious by now, when the roof panels 12 and 16 are joined, hook 26 engages under the bottom edge of locking button 32 in a continuous alternate spacing locking manner throughout the whole length of the panel. Then obviously, female leg 10 could only be lifted off of male leg 14 by pressing the female leg down over the male leg 14 until the hook 26 is completely disengaged below the lower edge of locking button 32, and then lip 24 pulled horizontally so that hook 26 is away from the bottom portion of locking button 32. However, as a practical matter, once the panels are placed down on the roof and the seams fastened together, the rigidity of the sheet metal is sufficient not to allow sufficient looseness between the two parts for separation to happen. In fact, the vertically upward going portion on each male and female leg portions of the panels which terminate upwardly in the apex 22 of the female leg and knee 15 of the male leg are so sized that there is very little space between the knee 15 and the underside of apex 22 of the female leg 10, in fact, just enough to let the locking buttons 32 fall upon the hook 26.

Referring now to FIG. 2, a perspective view of the subject invention which is utilized for locking standing seam roof panels into place is shown. The invention utilizes the commonly available locking type pliers, most commonly known as toggle type pliers illustrated by number 40. These toggle type pliers have the two pivoting, opening and closing handles, of which only a portion of the handle is shown in FIG. 2, and have been further modified by the addition of the so called "duck bills" jaws, shown as upper duck bill 42 and the lower duck bill 44. Up to this point, all that has been described is in the prior art, the duck bill toggle type pliers are commonly used in the sheet metal trade to hold flat pieces of sheet steel together for welding, drilling, or the like. The duck bills 42 and 44 are, in the prior art, usually welded to the upper and lower portions of the head of toggle type pliers 40.

Applicant's invention then is the addition of improvements to the duck bill toggle type pliers by the addition of two elements, namely the right-angle shaped piece of angle iron piece 46 which has the inside of one of the angles welded to the lower side of the lower duck bill 44. The duck bill 44 is placed into the channel of angle iron piece 46 so that the upright, perpendicular side of angle iron piece 46 extends slightly beyond the straight outer edge of lower duck bill 44 to form a groove. To the underside, and at its outside edge, of upper duck bill 42 is welded a piece of square shaped steel, commonly termed square rod 48. Shown in FIG. 2 are some of the weld fillets attaching square rod 48 and angle iron piece 46 to upper bill 42 and lower bill 44. Weld fillets will also be placed, as such in the case of square rod 48 and upper bill 42, along the joinder where square rod 48 touches the underside of upper bill 42, and similarily angle iron piece 46 will be additionally welded along the point where it touches the underside of lower duck bill 44.

In practice, it has been found convenient to make both angle iron piece 46 and square rod 48 of equal lengths and in the preferred embodiment, a total length of eight inches has proven to be most handily. Of course the invention is not limited to length or size of its individual elements. Referring now to FIG. 3, a side view of the subject invention being utilized locking standing seam roof panels is detailed. For clarity, the different portions of the drawing are shown separated from each other in space so that the details of the drawing will become much clearer to the reader. For example, the roof panels 16 and 12 vertically upright portions, numbers 17 and 13 respectively, are, in actual practice while being locked, abutting each other. However, to run both lines of the thin sheet material together may cause confusion and such is the reason the drawings are shown as such. In addition, it is noted that the duck bill toggle type pliers 40 have been turned over such that the upper and lower duck bills shown in FIG. 2 are now in opposite positions. However, for clarity, the dick bills shown in the lower position will still be referred to as upper duck bill 42 and vise versa on lower duck bill 44. Shown in FIG. 3 are the male and female leg portions having folded over at the top characteristics, i.e., apex 22 and knee 15. These are in some applications actually half-circle turns rather than sharp angles. The tool, however, will work with both, Also, the angle formed by lip 24 and side 13 is in practice not as great as shown here, since in viewing FIG. 3 it would appear there would be difficulty in latching locking button 32 into turned-up hook 26. Actually the angles between lip 24 and side 13 is approximately equal to the angle between side 17 and lip 30 of the male leg portion.

Continuing on with FIG. 3, positioning the invention in place is accomplished by aligning the edge of duck bill 42 and square rod 48 against side 17 and substantially resting upon the flat knee immediately below side 17 of male leg portion 14. It is anticipated that steel square rod 48 attached to upper duck bill 42 will engage the vertical upward side 17 of roof panel 16 so to urge the side 17 against its corresponding vertical side 13 of the next adjacent roof panel 12. While accomplishing this purpose, it is noted that square rod 48 is immediately below the bottom edge of lip 30 of roof panel 16.

Immediately above, apex 22 of the female leg 10 of roof panel 12 is engaged or will be engaged in the groove formed between the edge of the lower duck bill 44 and its attached angle iron piece 46. While having this groove to receive apex 22 is certainly convenient, it is noted that because of the rigidity inherent in the metal sides of the roof panels, it has been found that the subject invention is still operative when the angle iron piece 46 abuts the outside edge of duck bill 44. In this case, the female leg portion is held by one side of angle iron piece 46 and the bottom of duck bill 44.

Once the apex 22 of roof panel 12 has been engaged by duck bill 44 and angle iron piece 46 as well as the lower edge of lip 30 engaged by square rod 48, accomplished by slightly closing the pliers, the pliers are then more fully closed bringing the duck bills towards each other with the result that the male leg portion is brought up into the female leg where the locking button 32 rides up over the edge of hook 26 of the female leg.

Since the operator may not know when the lower portion of locking button 32 has in fact ridden up over the outstanding edge of hook 26, the subject invention if operated by the operator to close the combination of the male and female connection by having the knee 15 of the male leg rise up to stop immediately inside the metal forming the apex 22 of the female leg. At that point and time, sufficient resistance will be felt by the operator of the invention to indicate that bottoming has occurred and he may then release the grip and allow the male leg to drop to where locking button 32 bottom edge does fully engage hook 26 of the female leg.

Because of the rigidity of the material, it is anticipated that that portion of the panel directly engaged by angle iron piece 46 and square rod 48 will have its locking buttons 30 engaged by the hook 26, and in addition, several buttons on either end of the engaged portion of the roof will similarily engage.

After the first portion of the roof seam is engaged by the subject device, the handles of the toggle type pliers are released to their fullest position allowing the jaws to fall slack and to no longer engage the roof panels and the pliers are slid along to the next position by allowing the upper duck bill 42 and square rod 48 to ride against side 17 of the male leg and the knee adjoining side 17. The operator, in most cases, may visually inspect the roof panel seam and be able to tell when the locking buttons have in fact been engaged by the hook 26. In the event that there is any question, the operator merely needs to push down on the roof panel 16 or step on the roof panel 16. If the female portion of roof panel 12 then does not follow the movement imparted to the male leg portion of roof panel 16, it is apparent that the locking button has not yet engaged.

The locking operation is continued until the whole total seam has been connected.

While the preferred embodiment has been shown and described, it would be understood that there is no intent to limit the invention by such disclosure, but rather it is intended to cover all modifications and alternate construction falling within the spirit and the scope of the invention as defined in the appended claims.

I claim:

1. An improvement to toggle type pliers having two opposing jaws and co-acting handles, the improvement adapted to interlock male and female seam component parts in adjacent sheet metal standing seam roof panels, the improvement comprises:

an elongated rod attached to the inside of one of the pliers' jaws proximate the edge of the jaw and extending beyond the sides of the jaw, said elongated rod forming a lip adapted to engage the male seam component part; and an elongated right angle iron piece attached to the outside of the pliers' other jaw to define a groove between the outer edge of the jaw and the inside corner of the right angle iron piece, said elongated right angle iron piece extending beyond the sides of the jaw and said groove adapted to receive and secure the top of the female same component part whereby as the handles are brought together, the jaws come together and the elongated rod lip engaging the male seam component part brings the male seam component part into the female component part secured by the groove to effect a locking between the male and female seam component parts.

2. The device for locking adjacent sheet metal standing seam roof panels as defined in claim 1 wherein said jaws having attached elongated rod and elongated right angle iron piece defines toggle type pliers having wide blade jaws.

* * * * *